US006138380A

United States Patent [19]

Veijola et al.

[11] Patent Number: 6,138,380

[45] Date of Patent: Oct. 31, 2000

[54] METHOD AND APPARATUS FOR CONTROLLING THE TEMPERATURE IN A PAPER MACHINE

[75] Inventors: Jarkko Veijola; Hans Sundqvist; Jarkko Nurmi; Petri Norri, all of Turku, Finland

[73] Assignee: Valmet Corporation, Helsinki, Finland

[21] Appl. No.: 09/282,176

[22] Filed: Mar. 31, 1999

[30] Foreign Application Priority Data

Apr. 3, 1998 [FI] Finland ..... 980766

[51] Int. Cl.[7] ..... F26B 3/00

[52] U.S. Cl. ..... 34/446; 34/491; 34/111; 34/114; 34/122; 34/123

[58] Field of Search ..... 34/109, 110, 111, 34/114, 115, 116, 122, 123, 565, 540, 446, 491, 493

[56] References Cited

U.S. PATENT DOCUMENTS

| | | | |
|---|---|---|---|
| 3,085,347 | 4/1963 | Justus | 34/49 |
| 3,089,252 | 5/1963 | Daane et al. | 34/114 |
| 3,163,503 | 12/1964 | McKellar et al. | 34/122 |
| 4,033,049 | 7/1977 | Schiel et al. | 34/115 |
| 4,074,441 | 2/1978 | Helverson et al. | 34/122 |
| 4,096,643 | 6/1978 | Futcher | 34/122 |
| 5,383,288 | 1/1995 | Ilmarinen | 34/392 |
| 5,416,979 | 5/1995 | Joiner | 34/114 |
| 6,003,245 | 12/1999 | Lipponen et al. | 34/457 |

FOREIGN PATENT DOCUMENTS

| | | |
|---|---|---|
| 0 808 942 A2 | 5/1997 | European Pat. Off. . |
| 0 808 942 A3 | 11/1997 | European Pat. Off. . |
| 862412 | 8/1989 | Finland . |
| 904886 | 5/1996 | Norway . |

OTHER PUBLICATIONS

"The Papridryer Process, Part II—Mill Trials", Burgess et al, Technical Paper, vol. 73, No. 11, Nov. 1972.

*Primary Examiner*—Pamela Wilson
*Assistant Examiner*—Michelle A Mattera
*Attorney, Agent, or Firm*—Nixon & Vanderhye P.C.

[57] ABSTRACT

A method and device effect controlled uniform temperature drying of a wet web, such as a paper web substantially immediately after formation in a paper machine, without damaging the supporting fabric carrying the web. The web has a central region and first and second border regions. The wet web to be dried is conveyed on a conventional supporting fabric/wire in a first direction generally parallel to the web border regions, and in a hood drying air is blown against the web from the opposite side thereof as the supporting fabric so that the drying air picks up moisture and becomes moistened air. The moistened air is discharged from the volume adjacent the hood, for example is discharged from at least one hood positioned at and encompassing an impingement surface over which the web and supporting fabric pass. Air supplied for blowing against the web is heated to raise its ability to retain moisture. Drying air with a first temperature and first velocity is directed against a central region of the web, and drying air with a second temperature, lower than the first temperature, and second velocity, higher than the first velocity, is directed against the web in the border regions. The hood may be divided into at least one central block and first and second border blocks, corresponding to the central region and first and second border regions of the web. A first plurality of air nozzles may be disposed within the hood central block, and second and third plurality of air nozzles disposed in the hood first and second border blocks, with a different fan and heater supplying air to each of the plurality of air nozzles.

36 Claims, 6 Drawing Sheets

METHOD AND APPARATUS FOR CONTROLLING THE TEMPERATURE IN A PAPER MACHINE

The present invention relates to a method and an apparatus according to the preambles of the independent claims presented below for controlling the temperature of the drying air jets blown towards the border regions of a supporting fabric, such as a wire, supporting a track to be dried, such as a web which is dried in the drying section of a paper machine or or the like, so that the temperature is suitable regarding the heat resistance of the supporting fabric.

In the drying section of a paper machine the paper web is sometimes dried by impingement drying in addition to the conventional cylinder drying, or only by impingement drying. Then the web to be dried is guided with the aid of a supporting fabric to pass over a so called impingement surface, such as an impingement cylinder or a planar surface. At the same time the impingement drying system blows drying air jets towards the web.

A typical impingement drying system comprises at least one hood which is arranged to encompass at least a portion of the impingement surface, one or more nozzle boxes or similar provided with blow nozzle means and arranged within the hood, at least one fan arranged within or outside the hood, at least one heating means for heating the drying air, and means arranged in connection with the hood for removing moistened air from the space between the web to be dried and the nozzle box.

The web to be dried is guided, supported by the supporting fabric, typically a wire, so that it passes over a portion of the impingement surface encompassed by a hood, so that the wire passes between the web and the impingement surface. At the same time drying air jets are blown by blow nozzle means in the nozzle box towards the web which is dried. The nozzle box can be for instance a blowing box, a blowing chamber or any similar device. The moistened air generated between the web and the nozzle box is discharged. The discharged moistened air or compensating air can be heated by heating means and redirected as drying air into the nozzle box.

The impingement drying cylinder used in impingement drying has generally a diameter which is larger than that of a conventional drying cylinder, typically a diameter larger than two meters. The hood encompassing the impingement cylinder has often a two-piece structure. The hood can be divided by a partition into two symmetrical portions, so called hood modules, or it may be formed by two separate, generally symmetric hood modules, whereby it can be opened and easily removed from around the cylinder, even if it would encompass a large portion of the cylinder.

The nozzle surface of the nozzle box, the nozzle plate or any other means provided with nozzles are arranged in the hood, is arranged at a certain distance from the impingement cylinder, so that a suitable drying zone is formed between the nozzle surface and the cylinder. The paper web is to be dried is directed into this drying zone with the aid of different web guiding means, such as guiding rolls, guiding cylinders and/or guiding bodies.

Drying air is blown as smooth hot air jets towards the paper web to be dried. In an impingement drying system provided with an integrated air circulation the main part of the air blown towards the paper web is returned as circulating air into the hook, in order to be heated by heating means arranged in the hood, and in order to be blown again towards the web. In order to keep the moisture of the blown drying air at a desired level a part of the moist drying air returning from the web is removed as discharge air and replaced by a required amount of fresh compensating air. The invention can also be applied in such impingement drying systems where air, circulating air or compensating air, is heated in separate heating devices outside the hood.

An impingement drying system like that described above is presented in the Finnish laid-open publication FI 40683. In this previously known impingement dryer the whole upper part of the impingement cylinder is encompassed by a uniform hood. In the travelling direction of the web the hood is divided by a partition into two sections, each of which in turn is divided by partitions into separate blowing zones in the cross direction of the web. Each blowing zone is provided with an own fan, and the rotational speed of each fan can be individually controlled. The aim is to be able to control the drying rate of the web separately in each zone, i.e. the aim is to control the moisture profile of the web so that it will be uniform.

The web to be dried is guided from below onto the periphery of the impingement cylinder. This impingement drying cylinder system must be mounted above the conventional operating level of the paper machine, so that the web can be directed in a desired manner from below to the periphery of the cylinder and so that the hood can be opened, i.e. so that the hood can be freely moved outwards from the cylinder.

The solution as such requires relatively much space, and further it requires a robust support system which requires much space.

On the other hand the European patent application publication EP 0 808 942 A2 presents a device where the web is dried by through drying. Air is continuously supplied to the hood, from where air is directed as drying air into the suction roll, through the web to be dried and the wire while the web is guided over the suction roll. The air is discharged from the suction roll. Only porous paper qualities can be dried with the aid of through drying. In this solution it is proposed to control the moisture profile of the web by controlling the heating of the drying air.

Regarding the energy economy it would be advantageous to use a high blowing temperature in the impingement drying. Regarding the energy economy it would be advantageous to dry the paper web at a temperature over 300° C., for instance. However, then a problem is presented by the heat resistance of the supporting fabric, typically a wire. When the paper web is narrower then the wire supporting it the borders of the wire outside the paper web are directly exposed to the hot impingement air. In slow running machines the wire borders are continuously exposed to the hot air for a long time. On the other hand, in faster machines the wire travels rapidly over and over again into the impingement drying region and does not have time to cool sufficiently in the wire loop outside the impingement drying region. A high temperature can as such damage the wire, or at least reduce its durability and thus shorten its "lifetime".

Due to the above mentioned reasons an exposure of the wire borders to the impinging air should be avoided, or more preferably completely prevented when paper or board is dried by direct impingement drying. A control of the impingement width so that it would exactly correspond to the width of the web to be dried would be very difficult and would require a cumbersome measuring system and mechanical control equipment. The difficulty is accentuated by the fact that the position of the wire border can vary during operation. Moreover, the same machine and the same wire can often be used to dry webs with slightly differing widths.

Plastic wires such as PPS (Polyphenylene Sulfide) wires have been generally used in impingement drying. The melting temperature of said wire is 285° C. A safe operating temperature of the wire is about 100° C. lower, or below 200° C. Wires withstanding higher temperatures can be found on the market, but their prices are manifold, whereby the use of such wires will not often come into question in production machines. There have been attempts to solve this problem by treating the borders of conventional wires with a material which withstands the impingement drying conditions. However, the safest way to solve the problem has been to avoid high impingement temperatures.

The object of the present invention is to provide, in impingement drying in the drying section of a paper machine or similar, a method and a device with which the above mentioned problems due to the poor heat resistance of the wire can be minimised.

Particularly the object is to provide a solution which enables the use of impingement drying temperatures which are higher than previously.

Then an object is also to provide a method and a device which in addition to the above make it possible to obtain a good moisture profile.

A further object is to provide a device in impingement drying which saves space and which can be applied also in replacement of drying sections.

An object is also to provide a device in impingement drying which enables an easy removal of broke or similar from this area of the drying.

Further an object is to provide a device in impingement drying where the fan motors used in the drying and other means located outside the hood can be arranged so that they are protected from paper line, broke and dirt.

In order to reach the above mentioned objects the method and the device according to the invention is now characterised in what is said in the characterising clauses of the independent claims presented below.

In a typical drying section according to the invention the hood of the impingement drying system is divided into at least one central block which contains a nozzle box section or a corresponding section, which is arranged to blow drying air towards the central portion of the web, whereby the air temperature is $T_1$–$T'_1$, and into two border blocks which each contain a nozzle box section or a corresponding section, which is arranged to blow drying air towards the border regions of the web, whereby the air temperature $T_2$–$T'_2$ is lower than $T_1$–$T'_1$. The width of the border block is about 100 mm to 500 mm, typically 100 mm to 300 mm. On the other hand the hood has preferably at least two, typically more, central blocks, each of which is wider than the border block. Each border and central block most preferably has an own fan and own heating means.

The impingement surface can be a planar surface, whereby the hood encompasses a portion of this planar surface. Supported by the wire the web to be dried is guided over this surface. The wire passes between the impingement surface and the web.

However, the impingement surface is typically an impingement cylinder which is encompassed by two separate hoods. The first hood is arranged to encompass a first portion to the impingement cylinder casing and to form a first drying zone between the hood and this first portion, and the second hood is arranged to encompass a second portion of said impingement cylinder casing and to form a second drying zone between the hood and this second portion.

A typical new impingement drying system according to the invention comprises an impingement cylinder which at least partly is arranged below the floor level of the actual drying section. Two separate hoods or hood modules are arranged to encompass at least a portion of the upper half of the impingement cylinder so that an opening is left between the hoods above the impingement cylinder, whereby the web to be dried can be guided with web guiding means into and below the first hood which at least partly encompasses the cylinder, i.e. into the first drying zone formed between the cylinder and the hood. Correspondingly the web can also be guided through the opening and out from below the second hood partly encompassing the cylinder, i.e. from the second drying zone formed between the cylinder and the hood. Typically, the opening encompasses an angle of 50° to 80°, preferably about 70° of the cylinder casing.

In a typical application according to the invention the impingement cylinder is a perforated and/or grooved cylinder with a large diameter. Typically the diameter of the cylinder is greater than 2 m, preferably 2 to 8 m, generally 2.4 to 5.5 m. The perforated and/or grooved cylinder is typically provided with means to generate a negative pressure between the web and the cylinder in order to maintain a stable passage of the web when it passes along the cylinder surface conveyed by the wire. Only a very low negative pressure, even below 100 Pa is required in order to stabilise the web passage, i.e. in order to overcome the centrifugal force. The open area formed by the holes in the perforated cylinder can be small, generally less than 10%, typically less than 5%. When a grooved and perforated cylinder is used the open area can be less than 1%.

A large impingement cylinder encompassed by hoods, where the web to be dried is guided to the periphery of the cylinder from above, can be easily arranged below the actual drying level formed by the cylinders of the paper machine, i.e. the cylinder can be arranged partly or in its entirety below the floor level in the basement of the paper machine room. Below the drying section of a paper machine there is generally substantially more free usable space than above the drying section.

In a solution according to the invention the first and second hoods of the impingement drying system are arranged to encompass mainly only the side portions of the cylinder casing, so that an opening is left between the hoods also below the cylinder, whereby this opening encompasses an angle of 30° to 90°, preferably 40° to 60°, typically about 45° of the cylinder casing. The hoods are typically opened by moving the hoods sway from the periphery of the cylinder, either directly sidewards in a horizontal plane or obliquely downwards. It is also much easier to arrange space for this movement of the hoods below the drying section than above it. In the solution according to the invention the hoods can have two open positions at different distances. In the service position the distance between the hood and the cylinder could be about 1 meter. During a web break and threading the distance of the hood could be substantially shorter, even only a few hundred millimeters, for instance 500 mm.

The upper part of each hood is typically formed by two surfaces approaching each other in a wedge-like manner from below and upwards. A hood with a wedge-like upper part formed in this way can be designed with an outer surface which is downwards sloping, so that any broke, paper lint etc. can flow downwards by itself, away from the hood. On the wedge-like surface of the hood upper part it is possible to mount nozzles, such as slit nozzles to assist in removing broke or paper lint. The nozzles can be connected for instance to the compressed air network of the drying section.

The wedge-like top is typically arranged to be sloping so that one surface towards the cylinder forms the lower nozzle surface and the other surface away from the cylinder forms the outer wall of the hood. The nozzle surface is mainly curved, having the form of the curve of the periphery of the impingement cylinder. The hood is adapted against the cylinder so that a narrow gap is formed between this curved nozzle surface and the cylinder, whereby the gap forming the so called drying zone is generally less than 30 mm, preferably less than 25 mm, typically less than 20 mm. The outer wall of the hood, which thus in the downwards direction departs farther away from the nozzle surface, can also be curved, but preferably it mainly comprises straight wall sections. The wall sections are typically arranged sequentially in a form initiating a curve, so that the angle $\alpha$ between the wall sections and the horizontal plane increases in the downwards direction.

The apex portion of the hood, i.e. the apex formed by the top portions of the surfaces approaching each other, will typically form a relatively sharp wedge. This sharp top portion of the hood with a wedge-like form is advantageously arranged partly between the impingement cylinder and the guiding roll which guides the web onto the impingement cylinder. The top portion of the side wall of the hood may have a length of only 200 to 300 mm, and it can be almost horizontal.

When the impingement drying system according to the invention is located in the basement below the drying section and when the hood has an upwards tapering form, it can be made sure that broke formed during a web break will fall freely downwards from above the cylinder, along the outer wall of the hood, i.e. along the surface located away from the cylinder, and onto the broke conveyor passing below the impingement cylinder and further to the pulper. The fan motors, burners or other heating systems, cables, pipes etc. belonging to the impingement drying system can be mounted in the lower part of the hood or in protection below the hood.

During a web break and in connection with threading the paper lint sticking to the discharge air openings of the nozzle plate in the hood between the hood and the cylinder, can be "sneezed" out or blown out with the aid of reverse blowing, by generating a sufficiently abrupt pressure within the hood. When the hood or hoods are in the open position this required positive pressure impulse can be generated for instance by closing the discharge air channel of the hood for a moment and by supplying simultaneously a large amount of compensating air into the discharge air chamber.

The air circulation system of the impingement drying is mainly located within the hood or within the separate hood modules. In order to obtain a uniform moisture profile in the web it is advantageous to divide both hood modules into consecutive blocks in the machine cross direction, and to provide each block with an own short air circulation system. The drying air formed by the circulating air and the compensating air is advantageously blown independently from each block, i.e. from the space defined by each hood block, via a fan, a burner and an equalising chamber into the respective nozzle box, and from there as drying air jets further towards the web to be dried. Thus the web profile can be controlled independently in each block by adjusting both the fan speed and the blowing temperature. When temperature profiling is used there will not occur an energy loss corresponding to that which occurs when the profiling is made only with the aid of the air volume, where the air is throttled for instance with the aid of a louver.

The air is returned as circulating air from the web to be dried, either via discharge pipes in the nozzle box or through the slits running between the nozzle boxes directly to different blocks, so that the air can be recirculated. In the short integrated air system of the described type the pressure and temperature losses are substantially lower than in a system where the total impingement air volume is combined and recirculated as one flow with one fan, winding tens of meters at a high speed outside the hood before it is returned into the hood and dispensed into different blocks.

An aim in impingement drying systems is to perform the drying of the paper web with air having still a relatively high moisture content, i.e. without unnecessarily removing moisture from the air. Regarding the energy economy it is advantageous to keep a high moisture. In order to maintain a suitable, not too high moisture level, a part of the circulating air must be discharged and replaced with drier compensating air. In order to optimise the energy economy the heat of the discharged air can be recovered into the compensating air by guiding the compensating air and the discharged air through a common heat recovery system, such as through an air/air heat exchanger. The hot and moist air discharged from the circulation can also be used to heat the combustion air for the heaters. Even after this the energy contents of the air discharged from the impingement drying system can be utilised for other heat recovery in the frying section, when required.

In practice the air discharge from the hood and the supply of compensating air to the hood is advantageously arranged so that it is made through the hood by a discharge air channel and a compensating air channel which extend in the machine cross direction. When the hood is divided into blocks the channels are arranged to pass through the consecutive blocks, so that they remove a sufficient amount of discharge air from each block and add a sufficient amount of compensating air into each block. The compensating air channel is preferably arranged in each block adjacent the fan input located in the block, i.e. close to the lower part of the hood, and further the air supply openings of the compensating air channel are then preferably directed towards the fan, whereby the compensating air is easily directed to the fan. On the other hand the discharge air channel is located close to the fan boxes, through which discharge air is drawn from between the web and the hood into the hood. The openings of the discharge air channel are directed towards the nozzle boxes, whereby mainly only moist air is discharged from the blocks. Thus the openings of the compensating air channel and the discharge air channel are located so that compensating air flows in a desired manner into all blocks, and discharge air is removed in the desired manner from the hood.

In an advantageous solution according to the invention each hood or hood module is divided in the web cross direction into two border blocks, the border blocks of the tender side and the drive side, and into two or more central blocks between the border blocks. The border blocks and the central blocks can have the same width in the web cross direction, or they can have different widths. However, advantageously the border blocks arc often narrower than the central blocks, for instance so that the width of the border blocks is about 100 mm to 500 mm, preferably 300 mm to 500 mm. Both the fan power or the blowing rate, and the burner power or blowing temperature, are advantageously controlled separately in each block or block group. Regarding the energy economy the temperature is a more advantageous impingement drying parameter than the blowing rate.

In an impingement drying system according to the invention where the hood is divided into blocks, and where an own integrated air circulation system is arranged in each block, it is possible to use higher temperatures above 300° C., preferably above 350° C., to dry the centre portion of the web where the wire is not directly exposed to the hot air. On the other hand, in the narrow border blocks it is quite possible to use temperatures which are for instance more than 50° C., preferably more than 150° C. lower than the temperatures in the central blocks. A lower drying effect can be compensated with a correspondingly higher blowing rate, for instance a blowing rate over 100 m/s, preferably over 110 m/s. In the central blocks the blowing rate is generally less than 100 m/s, typically less than 90 m/s, even less than 80 m/s. The increased blowing power in the narrow blocks will not increase the power consumption too much. The wider the machine, the more savings in the fan effects can be achieved compared to the evaporation powers by dividing the hood into blocks.

In a system according to the invention it is thus possible to control the temperature of the drying air in the border blocks to a temperature which is below the heat resistance temperature limit, for instance to a temperature of about 200 to 350° C. In the central blocks it is on the other hand possible to use higher temperatures, such as a temperature of about 400 to 700° C., as the wire in this region is protected below the web. In the relatively narrow border blocks a lower temperature can be compensated by a higher blowing rate, for instance about 100 to 150 m/s, typically about 130 m/s.

On the other hand, in the central blocks blowing rate of the drying air jets can be kept relatively low, for instance at a level of about 50 to 100 m/s, typically about 70 m/s, whereby substantial savings in the blowing power are obtained.

The solution according to the invention secures in impingement drying that such conditions which the wire can withstand are used at a safe width from the edge of the web. This makes it possible to use advantageous temperatures regarding the energy economy in the drying. The invention makes it also possible to perform web drying at high temperatures better than previously, when the webs have different qualities, particularly different widths, without cumbersome measurement and control systems.

The impingement drying system according to the invention is well suited for applications in future paper machines with speeds exceeding even 2000 m/min, and on which the filling requirements are placed:

high efficiency,
effective drying,
good energy economy,
long wire life,
efficient use of space, also basement space,
good runability, i.e. support for the web during drying,
easy seviceability,
effective broke removal,
high paper quality, good profile.

The solution according to the invention enables the utilisation of the space below the paper machine and thus it reduces space requirements in the actual drying section, compared to corresponding previously known solutions. Moreover, the solution according to the invention requires remarkably little space outside the cylinder for external devices, because the actual air circulation system is located within the hood. It also enables a simple broke removal at the impingement drying system. The solution according to the invention where the hood is divided into blocks also makes it possible to have a precision control and a short air circulation in the drying, which provides a good energy economy and efficient drying. Then it also enables the web to be supported by the wire also in connection with impingement drying, whereby a good runability is obtained.

The invention is described in more detail below with reference to the enclosed drawings in which.

Figure 1:
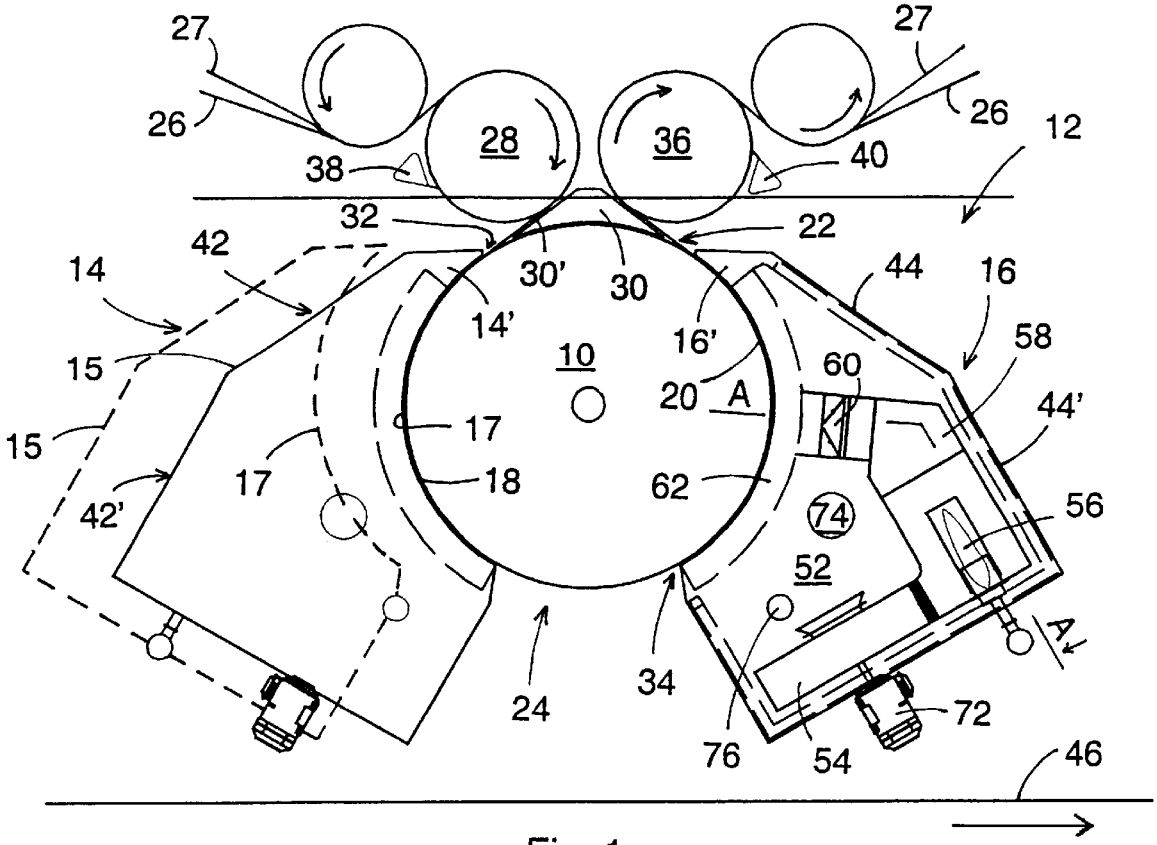
FIG. 1 shows as an example a schematic drawing of an impingement cylinder, on which an impingement drying system according to the invention is arranged, and where the hood on the right-hand side is presented in a vertical cross section in the machine direction and the hood on the left-hand side is presented as seen from one side of the machine.

FIG. 1 shows an impingement cylinder 10, which in this case is a cylinder provided with suction, and which is encompassed by an impingement drying system 12 according to the invention. The impingement drying system 12 comprises two hoods 14 and 16, which are arranged to encompass at least a portion of the upper half of the cylinder 10. The hoods shown in FIG. 1 encompass the mainly vertical curved sides 18 and 20 of the cylindrical periphery of the cylinder. The first hood 14 is presented as seen from the side of the machine. The second hood 16 is presented in a cross section. The outline of the hood 14 in the pulled-out position is shown by broken lines.

The hoods are box-like structures which are arranged in a slightly oblique position, so that they are slightly outwards sloping in the direction from the top downwards. The upper parts of the hoods are wedge-like, so that for instance the surfaces 15 and 17 of the hood 14 approach each other in the direction from below and upwards, so that between them they form a space tapering in a wedge-like manner.

The hoods according to the invention encompass generally at least 180° of the cylinder, typically about 200 to 260 degrees. Each hood encompasses separately at least 90° of the central portion of the cylinder side typically about 100° to 130°, whereby between the hoods 14, 16 there is left an opening 22 above the cylinder, and an opening 24 below the cylinder. The opening left above the cylinder between the hoods encompasses an able of about 50 to 80 degrees of the cylinder.

Supported by the wire 27 and guided by a cylinder 28 and guide means 30 the web 26 to be dried is directed into the space, the so called drying zone 32, between the hood 14 and the cylinder 10. The cylinder 28 is in this case one of the cylinders in the cylinder drying section of the paper machine. A so called runability component can be used as the means 30, such as the applicant's SymRun HS Blow Box, which ejects air away from the pocket formed between the cylinders 28, 36 and the cylinder 10, whereby the web to be dried moves in a stable manner, guided by the wire, from the drying cylinder 28 to the cylinder 10. When required, instead of the above mentioned blow box it is also possible to use other solutions to guide the web from the cylinder 28 to the cylinder 10, such as a suction box, or a combination of these.

In the solution according to FIG. 1 the means 30 is wedge-like and tapering from below and upwards. The narrow wedge-like top part of the guide means 30 is arranged to extend partly in between the cylinders 29 and 36, so that it partly seals the pocket space formed between the cylinders.

Supplied by the wire 27 the web 26 to be dried is directed from above into the space 32 between the cylinder 10 and the hood 14, out from the space 32 below the cylinder, past the opening 24 below the cylinder, from below into the space 34 between the cylinder 10 and the second hood 16, and from above out from the space 34, and further via the opening 22 and guided by the guide means 30 and the cylinder 36 away from the cylinder 10.

The drying cylinders 28 and 36 guiding the travel of the web are arranged above the cylinder 10, so that the cylinder 28 is located partly directly above the opening 22 and partly directly above the topmost narrow wedge-like portion 14' of the hood 14, and correspondingly the cylinder 36 is located partly directly above the opening 22 and partly directly above the topmost portion 16' of the hood 16. The wedge-like portion 14' of the hood extends partly within the horizontal projection of the cylinder 28. In the cylinders 28, 36 there are doctor blades 38, 40 arranged directly above the top portions 14', 16' of the hoods, so that the doctor blades scrape away broke or paper lint from the cylinders 28, 36 and drop it along the outer walls of the hoods.

The upper surfaces 42, 42' and 44, 44' of the hoods 14, 16 are mainly downwards sloping, so that broke which falls on the surfaces will by itself flow downwards along the surfaces and onto a broke conveyor below the cylinder 10, or on the floor 46. The main part of the upper surfaces of the hoods form an angle with the horizontal plane, which is typically between 30° and 90° and which ensures that the broke falls away.

An integrated impingement drying system is formed within the hoods 14 and 16. The FIG. 2 uses the same reference numerals as FIG. 1, and as it shows regarding the hood 16, the hoods are partly divided into separate blocks, the border blocks 48, 48' and the central blocks 50, 50', 50'', 50'''. Air is supplied by a blower 54 from the space 52 defined by the hood via the heater 56, the equalising chamber 58 and the control louvers 60, 60' into the central blocks 50, 50', of which the block 50 is shown in FIG. 1. Correspondingly, air is supplied by a blower 54' via the heater 56', the equalising chamber 58 and the control louvers 60'', 60''' into the central blocks 50'', 50'''. From the different blocks 50–50''' the drying air is supplied via the nozzle boxes 62–62''' with the aid of blow nozzles (not shown) towards the paper web to be dried which passes along the cylinder 10.

With the aid of a common equalising chamber 58 such violent action is avoided which the closure of one louver has on the other blow nozzles in the same nozzle box group.

Figure 2:
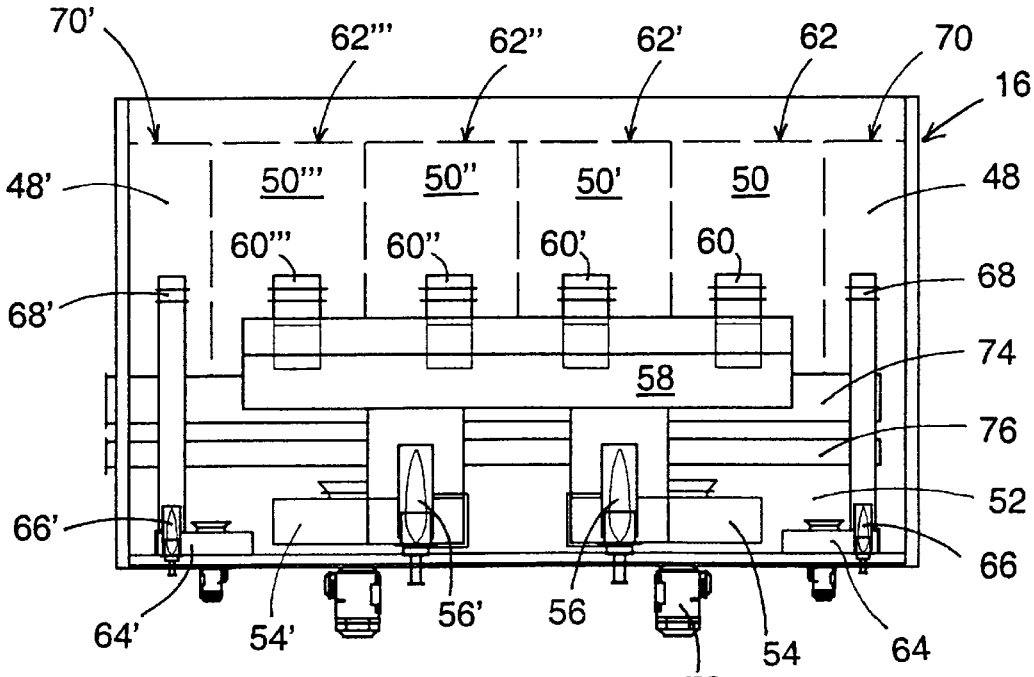
FIG. 2 shows schematically a cross section of the hood along line AA in FIG. 1.

Each of the border blocks 48, 48' shown in FIG. 2 has an own fan 64, 64' and burner 66, 66', and is directly via its own control louver 68, 68' in contact with the nozzle boxes 70, 70' at the border. The border blocks are narrower than the central blocks, so that in order to compensate for the lower temperature of the drying air flowing through them it is possible to maintain a high blowing rate in them without an extreme power consumption.

The fan motors 72 are arranged below the hoods so that they are protected from any broke and similar falling from above.

In FIGS. 1 and 2 there is also shown a discharge air channel 74 extending in the machine cross direction through the hood 16, so that this channel removes a part of the moist drying air returning into the hood from between the cylinder and the hood. The channel 74 is mounted close to the nozzle box 62, whereby mainly moist returning air flows into the channel.

Further the FIGS. 1 and 2 show a compensation air channel 76 passing through the hood 16 in the machine cross direction, so that the compensation air channel supplies fresh compensating air into the different blocks of the hood, in order to replace the discharged moist discharge air.

Figure 3:
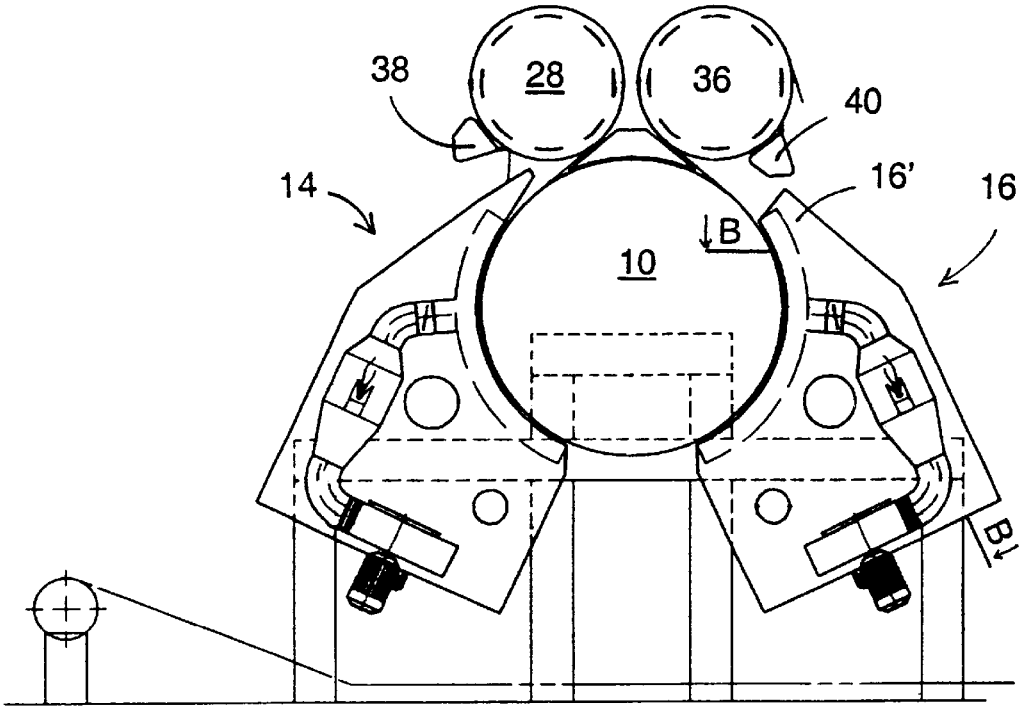
FIG. 3 shows schematically another impingement cylinder with an impingement drying system according to the invention.
Figure 4:
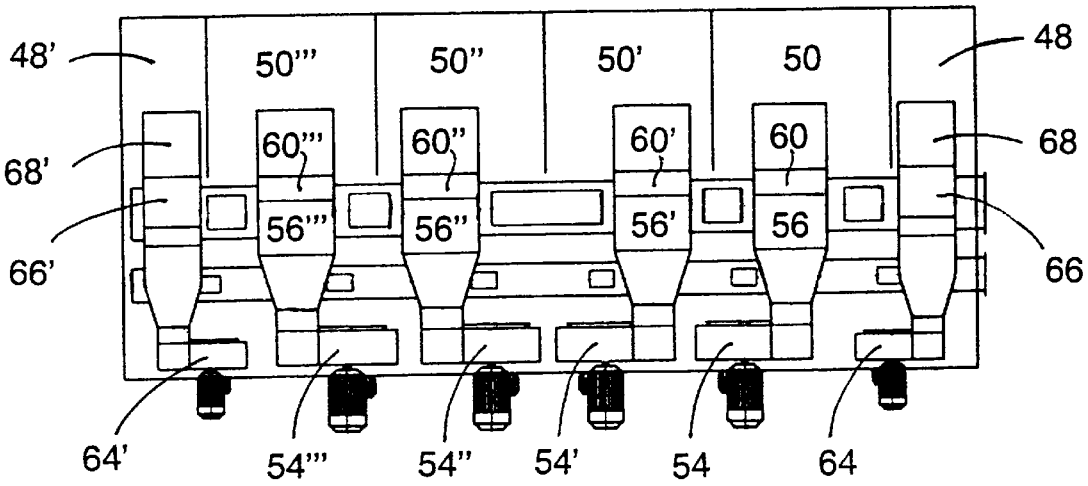
FIG. 4 shows schematically a cross section of the hood along the line BB in FIG. 3.

FIGS. 3 and 4 show in accordance with the FIGS. 1 and 2, and using the same reference numerals where applicable, another impingement drying system according to the invention which is applied in connection with the cylinder 10. The hoods 14 and 16 have a slightly differing form at the upper parts. The topmost part 14' of the hood 14 extends as a narrow apex between the cylinder 28 and the cylinder 10, so that any broke possibly coming from the doctor blade 38 will fall on the topmost part 14' of the hood. The topmost part 16' of the other hood is more blunt, and it is not necessary that it extends as far between the cylinder 36 and the cylinder 10, because the doctor blade 40 is arranged so that the broke removed by it will fall relatively far away from the cylinder 10.

Each of the hood blocks 50–50''', 48, 48' of the blowing systems in FIGS. 3 and 4 are provided with their own separate air circulation, i.e. each block has its own fan 54–54''', 64, 64' with motor, a burner 56–56''', 66, 66', and a control louver 60–60'''m 68, 68'.

Figure 5:
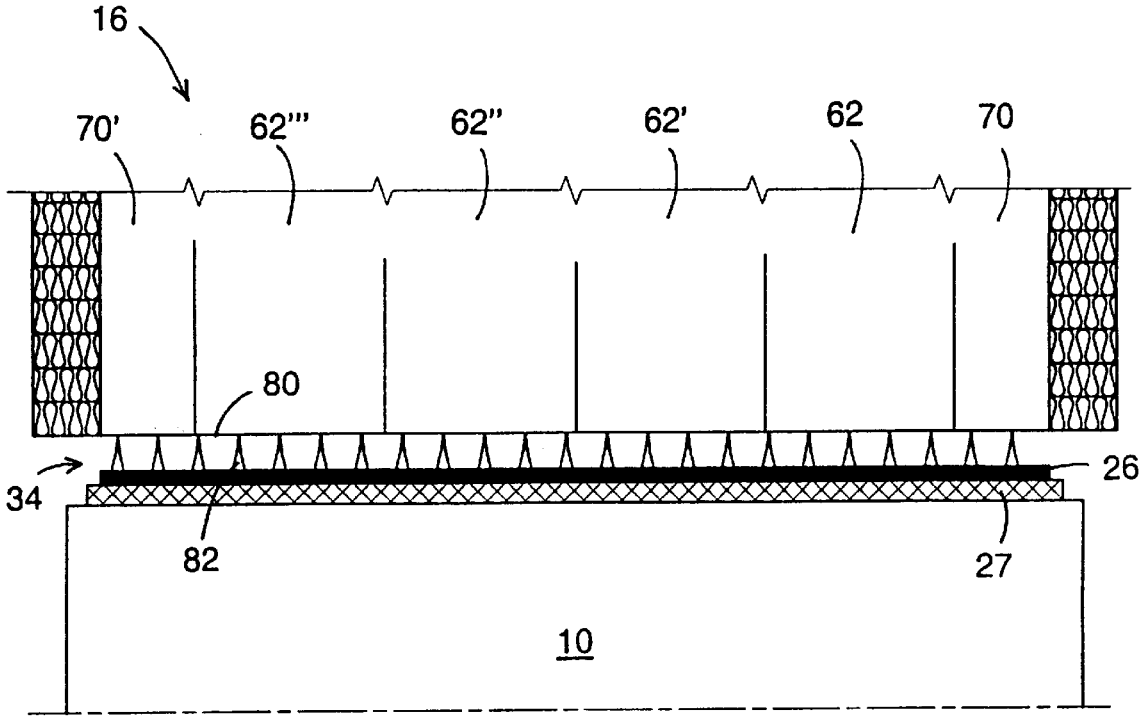
FIG. 5 shows schematically in the cross direction a cross section of a system according to the invention in the space between the impingement cylinder and the nozzle box.
Figure 6:
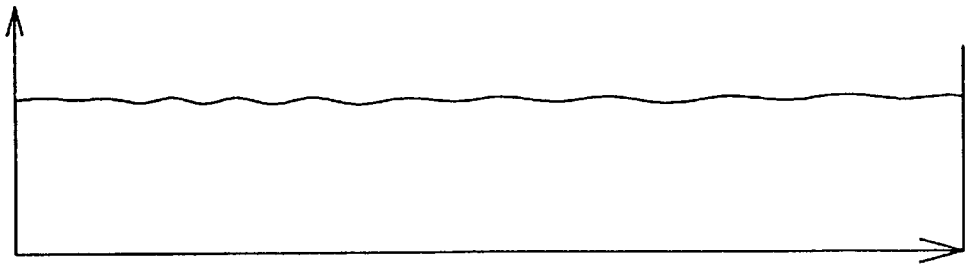
FIG. 6 shows the evaporation power profile in the web cross direction in a system according to the FIG. 5.

FIG. 5 shows the drying zone 34 between the cylinder 10 and the hood 16 in the impingement drying system according to FIGS. 3 and 4 where the web 26 to be dried passes, supported by the wire 27, along the periphery of the cylinder. The heat resistance of the wire is in this case over 300° C. Air jets 82 are blown through the nozzle plate 80 towards the paper web 26 from the nozzle boxes 62–62''', 70, and 70' of the hood blocks. Each hood block has its own fans and means for heating the drying air. From the nozzle boxes at the borders air is blown at 110 m/s and at a temperature of 300° C. Air is blown from the centre portions at 70 m/s and at a temperature of 450° C., which gives the uniform evaporation power profile in the cross direction shown in FIG. 6.

Figure 7:
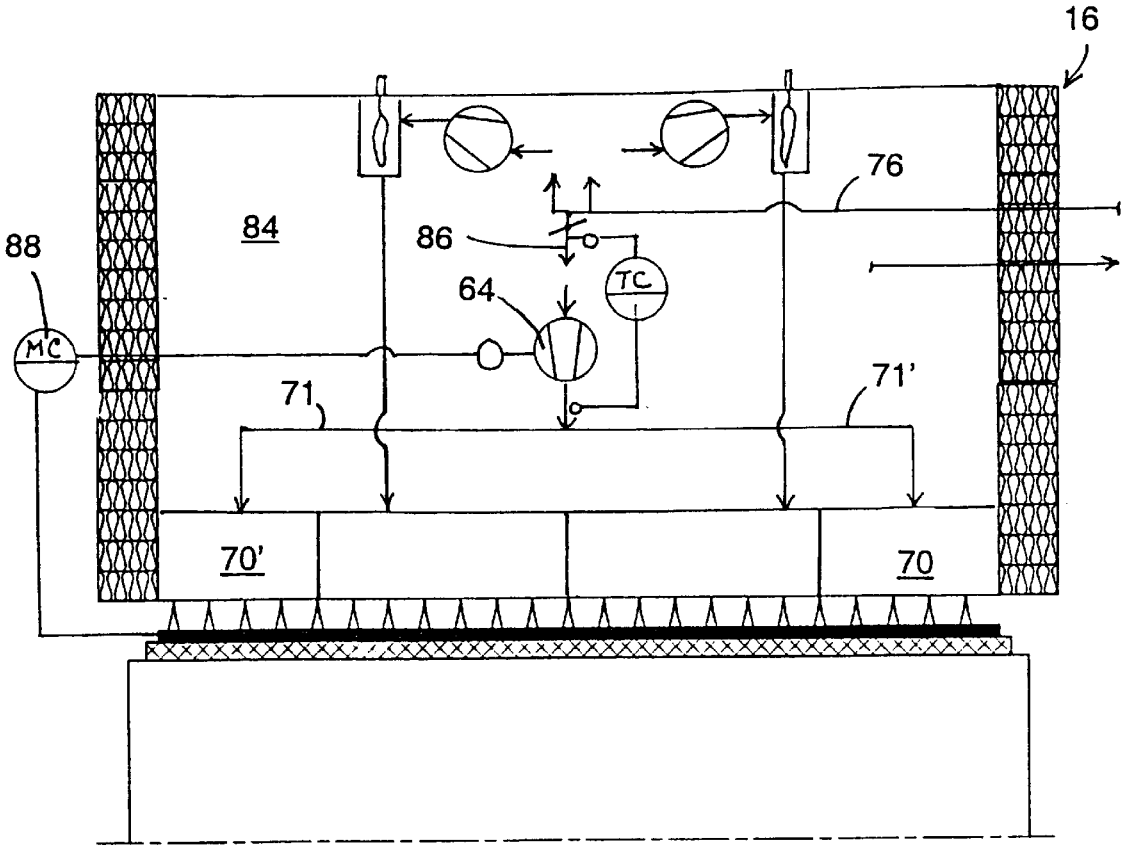
FIG. 7 shows another cross section according to the FIG. 5 of a blowing air system according to the invention.

FIG. 7 shows another impingement drying system, partly according to FIG. 5. In the impingement drying system presented in FIG. 7 an internal (integrated) air system is arranged within the hood. When required an external air system could be connected to the hood. In this embodiment of the invention the narrow border blocks 70, 70' of the nozzle boxes of the impingement hood 16 have a common fan 64 provided with an inverter, so that the fan directs the circulating air of the impingement system from the common hood discharge chamber 84 into these blocks. The temperature and the moisture of the blowing air supplied into the border blocks of the nozzle box can be controlled, in practice lowered, by adding from the compensating air channel 76 of the impingement hood a small amount of compensating air, through a smallish branch 86 provided with a separate control louver, into the circulating air 71, 71' which is supplied to the border blocks.

The louver and the compensating air volume are controlled on the basis of the temperature measured in the channel after the fan. Thus the total air balance of the impingement drying system will not change in any way; the total volumes of the compensating air, circulating air and discharge air remain unchanged. The measurement information about the web's moisture profile obtained with the device 88 is used to control the speed of rotation of the fan, and thus to control the blowing rate in the border blocks.

As an example we have an impingement drying case where the impingement drying parameters are: 350° C. 90 m/s and 0.2 kg $H_2O$/kg dry air; the temperature of the circulating air and the discharge air is of the order 243° C. and the moisture 0.24 kg $H_2O$/kg dry air. In other words, the temperature of the circulating air could cause problems with some wires, regarding the border blowing and the wire tolerance. By mixing compensating air into the circulating air the blowing temperature is easily reduced to a temperature of 200° C. At the same time the moisture content of the blowing air will decrease close to the optimum value regarding the drying effect and the energy economy, to about 0.2 kg $H_2$)/kg dry air. The blowing rate in the border blocks is substantially higher than 90 m/s.

The impingement drying system shown in FIG. 7 is a compact, simple, and regarding the border of the wire, a safe solution. The border blocks do not require any burner for heating the blowing air. One common smallish fan is sufficient for the border blocks. In practice the border blocks can be quite narrow.

Figure 8:
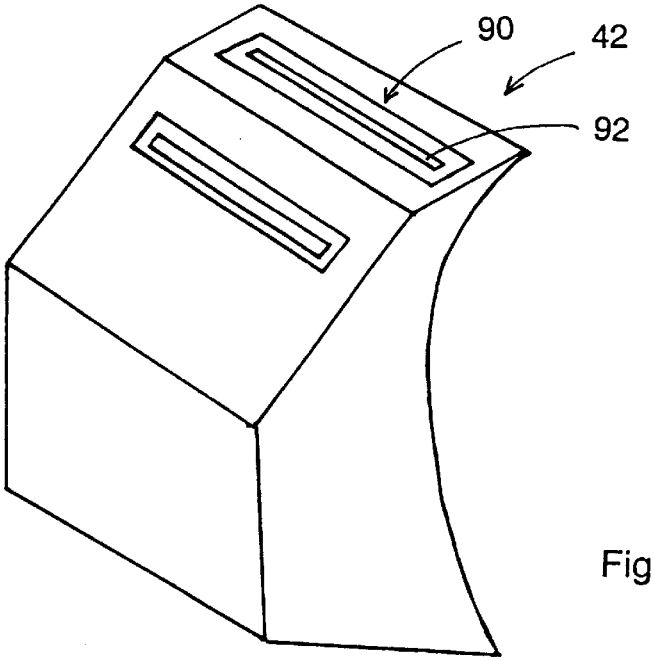
FIG. 8 shows a detail of the left hood in FIG. 1, seen obliquely from the side.

FIG. 8 shows a detail of the left hood 14 in FIGS. 1 and 3. A problem with an impingement hood arranged below the drying level is the paper rubbish falling from the cylinders during web breaks. Cleaning means can be combined with the hood solution according to the invention, with which means the hood surface can be cleaned with compressed air, when required. In the solution shown in FIG. 8 there are mounted two nozzle plates 90 on the hood upper surface 42, at the apex of the hood, and each plate has a slit nozzle 92 into which compressed air or other suitable cleaning medium such as compensating air can be supplied, provided that the medium is at a suitable pressure. When the web break automatics delivers information about a web break, the automatics controls the compressed air valve to open for a period of for instance 30 seconds. A longer time is not generally required, because in half a minute the web can be cut at the press, whereby the arrival of rubbish will stop.

Figure 9:
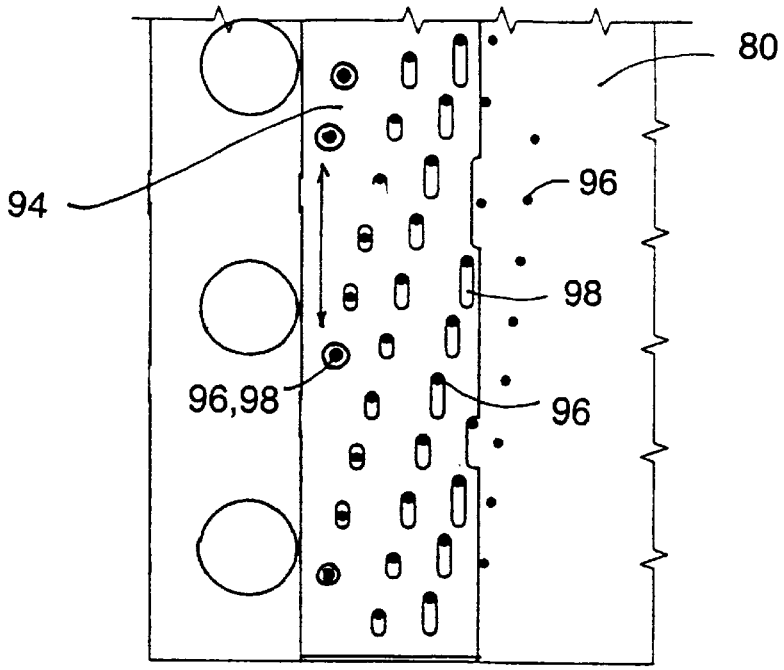
FIG. 9 shows schematically a border part of the nozzle plate controlled by an adjustment strip, located in the nozzle box according to the invention, when all nozzle holes are open.
Figure 10:
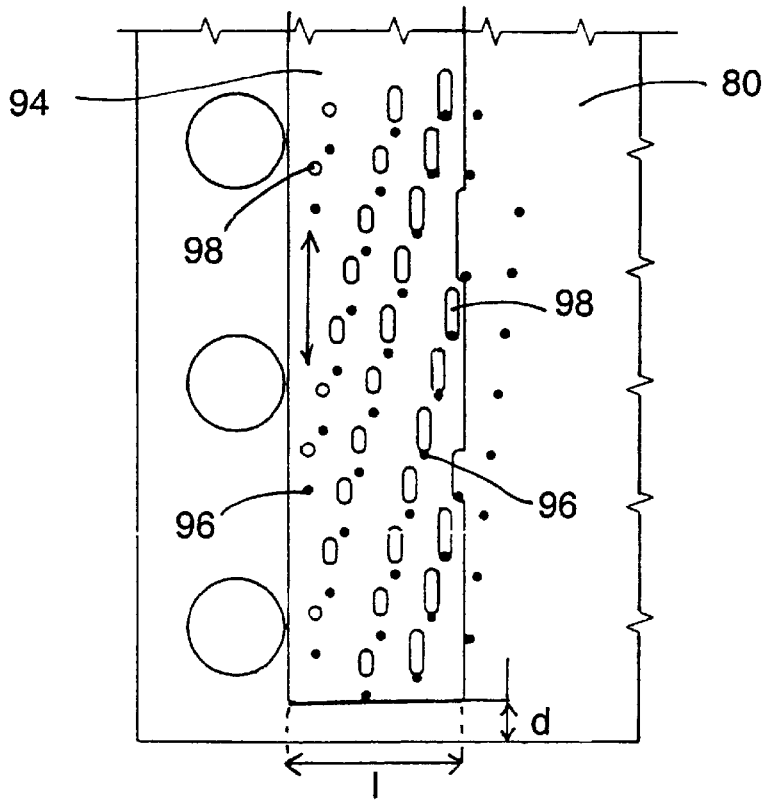
FIG. 10 shows the nozzle plate of FIG. 9 when all nozzle holes are closed.

FIGS. 9 and 10 show a solution with which it is possible to adjust the blowing width of the border blocks of the nozzle box in the hood of the impingement drying system according to the invention. The blowing width is adjusted with an adjustment strip 94. In FIG. 9 the adjustment strip 94 is adjusted into a position where all blowing holes 96 in the nozzle plate 80 are open; the holes are at the openings of the adjustment strip. In FIG. 10 the adjustment strip is adjusted into a position where almost all holes 96 are closed. The closed holes are hidden and covered by the adjustment strip (however, they are seen through the adjustment strip in FIG. 10). The diameters of the blowing holes are for instance about 5 mm in the case shown in the figures.

According to FIG. 9 an adjustment strip 94 is mounted on the surface of the nozzle plate 80 in the border block, so that the strip extends over the whole border block as seen in the web's travel direction and so that it covers a part of the nozzle plate, whereby the strip can be moved along the surface of the nozzle plate. The adjustment strip contains openings 98 of different sizes, of which some are elongated in the machine direction. The largest opening has a size in the machine cross direction which generally equals that of the blowing holes, and in the longitudinal machine direction its width is 25 mm, or 5 times the length of a blowing hole.

When the adjustment strip is moved the openings will either be positioned at the blowing holes 96 of the nozzle plate, whereby air can pass through the nozzle plate, or at a position where the nozzle plate has no openings, whereby air cannot flow through the nozzle plate. The openings 98 are formed in the adjustment strip so that when the strip is moved step-wise in the longitudinal machine direction they close/open blowing holes 96 over a certain width in the machine cross direction. The length of one step of the adjustment strip motion in the machine direction corresponds to the diameter of a nozzle hole. In the case of FIG. 9 the adjustment strip must be moved five steps in order to change the nozzle plate from a situation where all blowing holes are open into the situation of FIG. 10, where almost all holes are closed. The open area of the adjustment strip, i.e. The area of the openings in the strip, increases from the machine border towards the centre of the machine, so that when the adjustment strip is moved from the closing position to the opening position it will open the outermost holes as the last ones, and correspondingly when it is moved to the closing position it will close the holes closest to the centre of the machine as the last ones. The adjustment strip of FIG. 9 has been moved five steps, or the distance d compared to the adjustment strip of FIG. 10. At the same time the blowing width of the impingement hood at this border was reduced 85 mm, i.e. mainly corresponding to the width 1 of the adjustment strip. The adjustable nozzle hole pattern in the border area can differ from the rest of the blowing surface in order to achieve a greater adjustment width. The FIGS. 9 and 10 show only one advantageous solution. Naturally the adjustment strip can contain holes of different sizes and/or forms.

The border strips can be moved and thus the blowing width can be adjusted manually, or controlled automatically with the aid of an actuator. An automatic blowing width control can be made on the basis of the web's moisture profile or temperature profile, or on the basis of temperature measurements made at the wire borders. With a manual blowing width adjustment the positions of the border strips can be set visually on the basis of the web edges.

Figure 11:
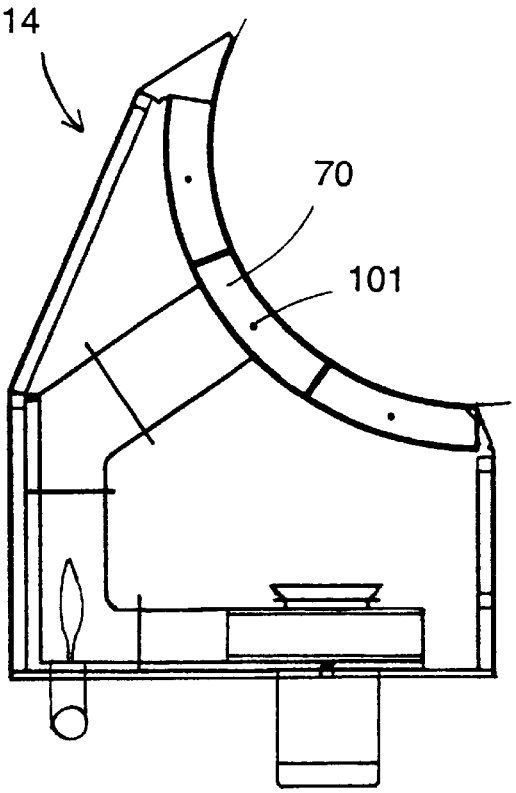
FIG. 11 shows schematically a cross section in the machine direction of a hood border portion according to the invention, to which there is arranged a piston controlling the size of the operating area of the border portion of the nozzle box.
Figure 12:
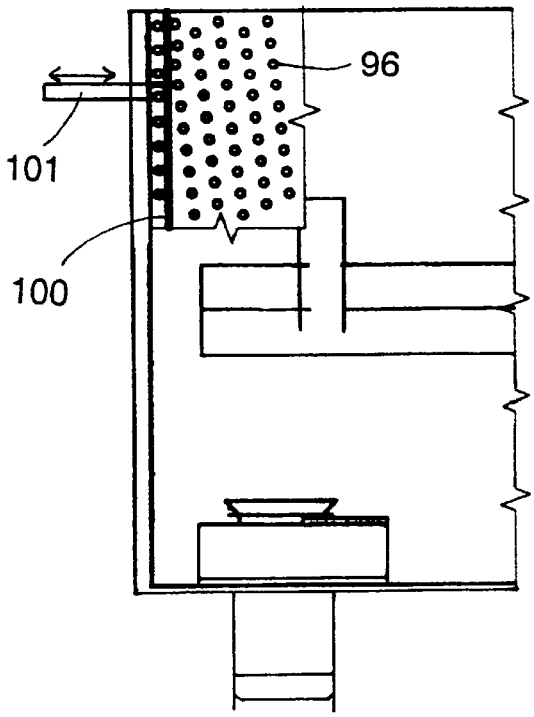
FIG. 12 shows a cross section in the machine cross direction of the other border portion of the hood in FIG. 11.
Figure 13:
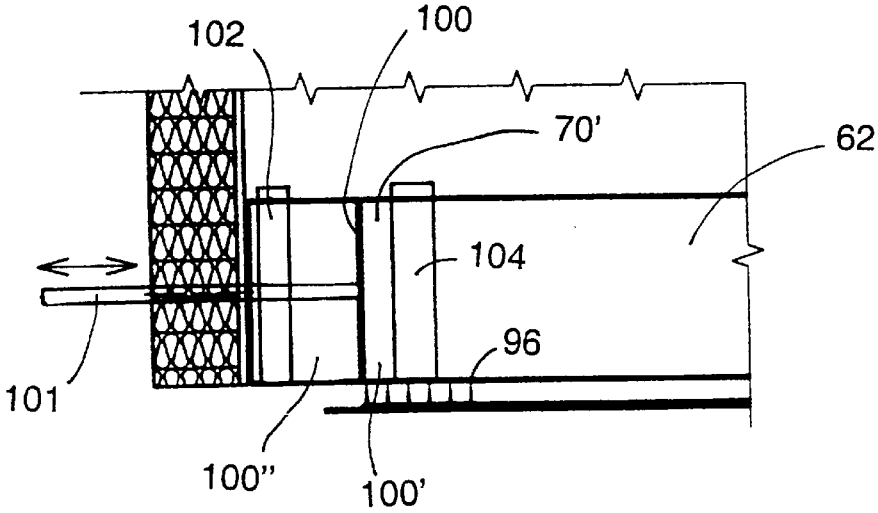
FIG. 13 shows a cross section according to FIG. 5, of the border portion of the hood in FIG. 11.

FIGS. 11 to 13 shown another solution applicable in the impingement drying system according to the invention in order to control the blowing width with the aid of the nozzle box 70, 70' arranged in the hood 14. With the impingement drying system according to the invention the web can be precision dried in its cross direction, taking into account the changing web widths of each quality and also any too high drying at the web borders.

The blowing width is adjusted with partitions, so called "pistons" 100, which are mounted at the edges of the outermost nozzle boxes 70, and which can be moved by a piston rod 101. The pistons can be pushed a determined distance from the edge of the outermost nozzle box towards the centre of the machine. The piston 100 divides the outermost nozzle box into two portions 100' and 100", of which only the first one 100', closest to the web's central portion, is connected to the air supply channel. The other, the outermost chamber 100" is a closed space, which does not receive air. The air from the first nozzle box portion is blown through the holes 96 towards the web to be dried.

In the solution according to the invention the movable partition or piston 100 controls the width of the nozzle box 70 as required, by preventing or limiting the air coming from the air channel to the nozzle box from reaching the closed border area and further from causing blowing from the nozzles in the respective border area.

When the partitions movable in a nozzle box are in a position which enables the largest blowing width, they are bounded to the outermost discharge air ducts 102 extending through the nozzle box, and when the partitions are in a position which enables the minimum blowing width they are bounded to the next discharge air duct row 104. The discharge air ducts can be consecutively arranged in two rows in the border regions of the nozzle box, so that the space between the rows is positioned in that region where the aim is to control the border blowing i.e. where the controlling piston should be able to move. The partitions which control the blowing width are moved by rods 101 which extend outside the hood, through the end of the nozzle box 70, through the isolating layer and the end wall of the hood. The rod 101 can be moved either manually, or automatically with the aid of an actuator. The control can be made on the basis of the web's moisture profile or temperature profile, or on the basis of point measurements made at the borders of the web and/or the wire immediately after the impingement drying.

According to an advantageous embodiment of the invention the border blocks 70 can be divided in the web's travelling direction into a required number of consecutive portions, for instance three portions, each of which has its own separate controlling piston. The movable piston can be made of steel plate and/or of some flexible, heat resistance material, so that when required it can be made to pass very tightly along the nozzle box wall, also when the wall is curved and possibly slightly deformed with the temperature.

The invention is not intended to be restricted to the embodiments shown in the FIGS. 1 to 13 above, but on the contrary, the intention is that the invention can be widely applied within the inventive idea defined in the claims presented below.

What is claimed is:

1. A method for effecting controlled temperature drying of a wet web having a central region and first and second border regions, comprising:

(a) conveying the wet web to be dried on a moving support in a first direction generally parallel to the web border regions;

(b) blowing drying air against the web from the opposite side thereof as the moving support, so that the drying air picks up moisture and becomes moistened air;

(c) discharging the moistened air from the volume adjacent the web;

(d) heating at least one of the discharged moistened air and make-up air to raise the ability thereof to retain moisture, and redirecting the heated air for use in (b); and wherein (b) is practiced by blowing drying air within a first temperature range against the central region of the web, and by blowing drying air within a second temperature range, lower than the first temperature range, against the web in the border regions.

2. A method as recited in claim 1 wherein (a)–(d) are practiced using a paper web substantially immediately after formation in paper machine; wherein (b) is practiced so that the lowest temperature in the first temperature range is at least 50 degrees C. higher than the highest temperature in the second temperature range; and wherein the velocity of the drying air directed against the web is different in the central region compared to the border regions.

3. A method as recited in claim 1 wherein (b) is practiced by blowing drying air against the web in the central region of the web at a first velocity, and by blowing drying air against the web in the border regions at a second velocity which is higher than the first velocity.

4. A method as recited in claim 2 wherein (b) is practiced so that the first velocity is less than 100 m/s and the second velocity is greater than 100 m/s.

5. A method as recited in claim 2 wherein (b) is practiced so that the first velocity is less than about 90 m/s and the second velocity is greater than about 110 m/s.

6. A method as recited in claim 3 wherein (b) is practiced so that the first velocity is less than about 80 m/s and the second velocity is greater than about 130 m/s.

7. A method as recited in claim 3 wherein (b) is practiced so that the border regions each have a width of between about 100–500 mm.

8. A method as recited in claim 3 wherein (b) is practiced so that the border regions each have a width of between about 100–300 mm.

9. A method as recited in claim 3 wherein (b) is practiced so that a different fan supplies blowing air to each of the central and border regions.

10. A method as recited in claim 1 wherein (a)–(d) are practiced using a paper web substantially immediately after formation in a paper machine; wherein (b) is practiced so that the lowest temperature in the first temperature range is at least about 150 degrees C. higher than the highest temperature in the second temperature range.

11. A method as recited in claim 1 wherein (b) is practiced so that the lowest temperature in the first temperature range is at least 50 degrees C. higher than the highest temperature in the second temperature range.

12. A method as recited in claim 5 wherein (b) is practiced so that the lowest temperature in the first temperature range is at least 50 degrees C. higher than the highest temperature in the second temperature range.

13. A device for controlling the temperature of drying air blown against a wet web having a central region and first and second border regions, said device comprising:

a moving supporting fabric, supporting the wet web for movement therewith;

an impingement surface which guides the travel of the web and supporting fabric and over which the web and supporting fabric pass;

at least one hood positioned to encompass at least a portion of said impingement surface, and web and supporting fabric passing thereover;

said hood divided into at least one central block and first and second border blocks, corresponding to said central region and said first and second border regions;

a first plurality of air nozzles disposed within said hood central block and positioned to direct air therefrom toward said central region of the web to dry the web, and a first fan which supplies pressurized air to said first plurality of air jets;

second and third pluralities of air nozzles disposed within said hood first and second border blocks, respectively, and positioned to direct air therefrom toward said first and second border regions of the web to dry the web, and at least a second fan which supplies pressurized air to said second and third pluralities of nozzles;

at least one heater which heats the air supplied to said air of nozzles;

means for removing from said hood moistened air generated by air from said air nozzles being blown against the web; and said first plurality of air nozzles blowing air against said central region of the web having different temperature and velocity than the air blown against said border regions of the web by said second and third pluralities of air nozzles.

14. A device as recited in claim 13 wherein each of said border blocks is dimensioned and positioned to define a border region of the web between about 100–500 mm.

15. A device as recited in claim 14 wherein said at least one second fan comprises a different fan for each of said second and third pluralities of air nozzles, and wherein said at least one heater comprises a different heater for each of said first, second, and third pluralities of air nozzles.

16. A device as recited in claim 13 wherein said at least one central block comprises at least two central blocks, each of which is wider than either of said border blocks, and wherein different first pluralities of air nozzles are provided in said central blocks, each of said pluralities having a distinct heater and fan associated therewith.

17. A device as recited in claim 13 wherein said impingement surface is substantially flat.

18. A device as recited in claim 13 wherein said impingement surface comprises an impingement cylinder having a casing.

19. A device as recited in claim 18 wherein said impingement cylinder has a diameter between about 2.4–5.5 m.

20. A device as recited in claim 18 wherein said impingement cylinder casing is at least one of perforated or grooved, so that said casing has an open area that is less than 5%.

21. A device as recited in claim 18 wherein said at least one hood comprises a first hood positioned to encompass a first portion of said cylinder casing and to form a first drying zone, and a second hood positioned to encompass a second portion of said cylinder casing and to form a second drying zone;

wherein said first and second hoods are positioned so that said hoods encompass at least a portion of said upper half of said impingement cylinder, so that an opening is provided between said cylinder and upper parts of said hoods; and further comprising:

web guiding means positioned in said opening for directing the web through said opening into said first drying zone and out from said second drying zone.

22. A device as recited in claim 21 wherein said opening between said cylinder and said upper part of said hoods covers an angle of about 50–80 degrees of said cylinder casing.

23. A device as recited in claim 21 wherein said first and second hoods encompass primarily only side portions of said cylinder casing, so that a bottom opening is provided between said hoods and below said cylinder; said bottom opening covering an angle of about 30–90 degree of said cylinder casing.

24. A device as recited in claim 18 wherein said upper surface of said at least one hood slopes downwardly and away from said cylinder so that said upper surface of said at least one hood forms an angle of between 30–90 degrees with the horizontal plane; and further comprising a plurality of nozzles mounted on said upper surface of said at least one hood for blowing away material from above said hood.

25. A device as recited in claim 18 wherein said hood encompasses about 100–130 degrees of said impingement cylinder casing.

26. A device as recited in claim 13 wherein said at least one central portion of said at least one hood is divided into consecutive central blocks in the cross direction of the web, each central block having a plurality of air nozzles therein; and further comprising an equalizing chamber positioned between said central blocks so as to equalize the pressure supplied to said air nozzles therein.

27. A device as recited in claim 13 wherein said at least one hood is divided into consecutive blocks in a web cross direction; and further comprising a discharge air channel extending primarily across the web in order to collect the discharge air from said consecutive blocks; and a compensating air channel extending across the web in order to supply compensating air into said consecutive blocks.

28. A device as recited in claim 13 wherein said heater comprises a fan and a burner.

29. A device as recited in claim 13 wherein each of said border blocks comprises a partition movable to divide said border block into two consecutive portions in the web cross direction, said partition closing off outermost air nozzles of said second and third pluralities of air nozzles so as to prevent overheating of a border of said supporting fabric.

30. A device for controlling the temperature of drying air blown against a wet web having a central region and first and second border regions, said device comprising:

a moving supporting fabric, supporting the wet web for movement therewith;

an impingement surface which guides the travel of the web and supporting fabric and over which the web and supporting fabric pass;

at least one hood positioned to encompass at least a portion of said impingement surface, and web and supporting fabric passing thereover;

said hood divided into at least one central block and first and second border blocks, corresponding to said central region and said first and second border regions;

a first plurality of air nozzles disposed within said hood central block and positioned to direct air therefrom toward said central region of the web to dry the web, and a first fan which supplies pressurized air to said first plurality of air nozzles;

second and third pluralities of air nozzles disposed within said hood first and second border blocks, respectively, and positioned to direct air therefrom toward said first and second border regions of the web to dry the web, and a second fan which supplies pressurized air to said second and third pluralities of air nozzles;

a nozzle plate in each of said border blocks, including a plurality of outermost holes therein;

at least one heater which heats the air supplied to said air nozzles;

means for removing from said hood moistened air generated by air from said air nozzles being blown against the web; and an adjustment strip disposed in each of said border blocks to provide closing of outermost holes in said nozzle plates so as to prevent overheating of said supporting fabric.

31. A device for controlling the temperature of drying air blown against a wet web having a central region and first and second border regions, said device comprising:

a moving supporting fabric, supporting the wet web for movement therewith;

an impingement cylinder which guides the travel of the web and supporting fabric and over which the web and supporting fabric pass, and having a cylinder casing, and an upper half;

a first positioned to encompass a first portion of said cylinder casing and to form a first drying zone, and a second hood positioned to encompass a second portion of said cylinder casing and to form a second drying zone;

wherein said first and second hoods are positioned so that said hoods encompass at least a portion of said upper half of said impingement cylinder, so that an opening is provided between said cylinder and upper parts of said hoods;

web guiding means positioned in said opening for directing the web through said opening into said first drying zone and out from said second drying zone;

a first plurality of air nozzles disposed within said hood and positioned to direct air therefrom toward said central region of the web to dry the web;

second and third pluralities of air nozzles disposed within said hood and positioned to direct air therefrom toward said first and second border regions of the web to dry the web;

at least one fan for supplying pressurized air to said first, second, and third pluralities of air nozzles;

at least one heater which heats the air supplied to said air nozzles; and means for removing from said hood moistened air generated by air from said air nozzles being blown against the web.

32. A device as recited in claim 31 wherein said opening between said cylinder and said upper part of said hoods covers an angle of about 50–80 degrees of said cylinder casing.

33. A device as recited in claim 31 wherein said first and second hoods encompass primarily only side portions of said cylinder casing, so that a bottom opening is provided between said hoods and below said cylinder; said bottom opening covering an angle of about 30–90 degree of said cylinder casing.

34. A device as recited in claim 31 wherein said web guiding means comprises a portion of said first hood and a first roll arranged above said opening between said hoods so that the web is directed into said first drying zone with the aid of said first roll, and a doctor blade positioned in operative association with said first roll to remove broke from said first roll in the case of a break, said doctor blade positioned so that broke removed thereby drops on a downwardly sloping top surface of said first hood.

35. A device as recited in claim 34 wherein said web guiding means further comprises a second roll disposed partly above said upper part of said second hood and partly above said opening between said hoods so that the web is directed away from the second drying zone with the aid of said second roll; and a doctor blade mounted in connection with said second roll to remove broke from said second roll in the case of a break, and positioned so that the broke removed drops on a downwardly sloping top surface of said second hood.

36. A device for controlling the temperature of drying air blown against a wet web having a central region and first and second border regions, said device comprising:

a moving supporting fabric, supporting the wet web for movement therewith;

an impingement cylinder which guides the travel of the web and supporting fabric and over which the web and supporting fabric pass, and having a cylinder casing, and an upper half;

at least one hood positioned to encompass a portion of said cylinder casing and having a lower part;

a first plurality of air nozzles disposed within said hood and positioned to direct air therefrom toward said central region of the web to dry the web;

second and third pluralities of air nozzles disposed within said hood and positioned to direct air therefrom toward said first and second border regions of the web to dry the web;

at least one fan for supplying pressurized air to said first, second, and third pluralities of air nozzles, said at least one fan having a motor and wherein at least a portion of said fan is positioned within said hood, and wherein said motor is protected below said lower part of said hood;

at least one heater which heats the air supplied to said air nozzles; and means for removing from said hood moistened air generated by air from said air nozzles being blown against the web.

* * * * *